US008314768B2

(12) United States Patent
Choi et al.

(10) Patent No.: US 8,314,768 B2
(45) Date of Patent: Nov. 20, 2012

(54) BACKLIGHT UNIT, DISPLAY APPARATUS HAVING THE SAME AND METHOD OF INSPECTING THE SAME

(75) Inventors: Min-Soo Choi, Asan-si (KR); Hwanwoong Lee, Asan-si (KR); Won Sik Oh, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 524 days.

(21) Appl. No.: 12/705,608

(22) Filed: Feb. 14, 2010

(65) Prior Publication Data

US 2011/0032179 A1 Feb. 10, 2011

(30) Foreign Application Priority Data

Aug. 7, 2009 (KR) ..... 10-2009-0072900

(51) Int. Cl.
*G09G 3/36* (2006.01)

(52) U.S. Cl. ..... 345/102; 345/87

(58) Field of Classification Search ..... 345/87, 345/102, 156, 204
See application file for complete search history.

(56) References Cited

U.S. PATENT DOCUMENTS

| | | | | |
|---|---|---|---|---|
| 6,727,877 | B2 * | 4/2004 | Itakura | 345/94 |
| 2002/0126076 | A1 * | 9/2002 | Itakura | 345/87 |
| 2004/0056831 | A1 * | 3/2004 | Takatori et al. | 345/88 |
| 2008/0158140 | A1 * | 7/2008 | Takatori et al. | 345/102 |
| 2010/0225622 | A1 * | 9/2010 | Wang et al. | 345/204 |

FOREIGN PATENT DOCUMENTS

| | | |
|---|---|---|
| JP | 2008-130295 | 6/2008 |
| JP | 2008-130377 | 6/2008 |
| JP | 2008-130513 | 6/2008 |

* cited by examiner

*Primary Examiner* — Ricardo L Osorio
(74) *Attorney, Agent, or Firm* — Cantor Colburn LLP

(57) ABSTRACT

A backlight unit includes light source groups, a converter, a compensator, a detector and a protector. Each of the light source groups includes a light source, and the converter boosts an input voltage to a driving voltage that is supplied to the light source groups. The compensator is connected to the light source groups and compensates a deviation between currents fed back to the compensator from each of the light source groups. The detector is connected between the compensator and the light source groups and detects a maximum voltage from among feedback voltages fed back to the compensator from each of the light source groups. The protector is connected to the detector and receives the maximum voltage, and compares the maximum voltage to a reference voltage to generate a compared result. The protector outputs a protection signal to the converter based on the compared result.

20 Claims, 4 Drawing Sheets

BACKLIGHT UNIT, DISPLAY APPARATUS HAVING THE SAME AND METHOD OF INSPECTING THE SAME

This application claims priority to Korean Patent Application No. 10-2009-0072900, filed on Aug. 7, 2009, and all the benefits accruing therefrom under 35 U.S.C. §119, the content of which in its entirety is herein incorporated by reference.

BACKGROUND OF THE INVENTION

1. Field of the Invention

The present invention relates to a backlight unit, a display apparatus having the same and a method of inspecting the backlight unit. More particularly, the present invention relates to a backlight unit which detects an abnormal condition of a light source included therein, a display apparatus having the backlight unit and a method of inspecting, e.g., testing, the backlight unit.

2. Description of the Related Art

A liquid crystal display ("LCD") typically includes a liquid crystal layer interposed between two display substrates. To display an image, the LCD controls a transmittance of a light passing through the liquid crystal layer. However, since the LCD is not a self-emissive device, the LCD requires a light source as a backlight unit.

The backlight unit may include a light emitting diode, for example, as a light source for generating the light. More particularly, the backlight unit typically includes a light emitting diode string having light emitting diodes connected to each other in electrical series. However, if any one of the light emitting diodes included in the light emitting diode string fails or malfunctions, the entire light emitting diode string becomes inoperable, and the light emitting diode string cannot operate effectively as the light source of the backlight unit.

BRIEF SUMMARY OF THE INVENTION

An exemplary embodiment of the present invention provides a backlight unit which detects an abnormal condition of a light source and controls an operation of the light source based on the same.

Another exemplary embodiment of the present invention provides a display apparatus having the backlight unit.

Still another exemplary embodiment of the present invention provides a method of inspecting, e.g., testing, the backlight unit, in which an abnormal condition of the light source is detected and identified during operation of the backlight unit.

According to one or more exemplary embodiments of the present invention, a backlight unit includes light source groups, a converter, a compensator, a detector and a protector. Each of the light source groups has a light source. The converter boosts an input voltage to a driving voltage and supplies the driving voltage to the light source groups. The compensator is connected to the light source groups and compensates a deviation between currents fed back to the compensator from the light source groups. The detector is connected between the compensator and the light source groups to detect a maximum voltage from among feedback voltages fed back to the compensator from the light source groups. The protector is connected to the detector, and receives the maximum voltage, compares the maximum voltage to a reference voltage and outputs a protection signal to the converter based on a compared result.

In one or more exemplary embodiments, the detector includes a plurality of first diodes connected to the light source groups, and each first diode of the plurality of first diodes has an anode connected to a corresponding light source group of the light source groups and a cathode connected to the protector.

In one or more exemplary embodiments, the protector includes a first comparator which receives the maximum voltage and the reference voltage and outputs the protection signal when the maximum voltage is greater than the reference voltage.

In one or more exemplary embodiments, the reference voltage is a maximum deviation value of deviation values of the feedback voltages fed back to the compensator from the light source groups.

In one or more exemplary embodiments, the protector further includes a second comparator which receives the protection signal from the first comparator and a dimming signal, which dims the light source groups, and outputs the protection signal when the dimming signal is at a high level.

In one or more exemplary embodiments, the compensator includes switching devices, each connected to one of the light source groups. At least one resistor is connected to each of the switching devices.

In one or more exemplary embodiments, each of the switching devices has a first terminal connected to a corresponding light source group of the light source groups, a second terminal connected to a ground terminal and a third terminal which controls an electrical connection between the first terminal and the second terminal.

In one or more exemplary embodiments, the backlight unit further includes a controller which receives the protection signal and controls a boosting operation of the converter.

In one or more exemplary embodiments, the converter includes an inductor which receives the input voltage, a second diode connected to the inductor to rectify a current based on the input voltage, a capacitor connected between the second diode and a ground terminal and which is charged by the input voltage, and a second switching device connected to the controller, the ground terminal and a node disposed between the inductor and the second diode. The controller turns off the second switching device in response to the protection signal when the maximum voltage is greater than the reference voltage.

According to additional exemplary embodiments of the present invention, a display apparatus includes a display panel, light source groups, a converter, a compensator, a detector and a protector. The display panel receives a light and displays an image using the light. Each of the light source groups has a light source and supplies the light to the display panel. The converter boosts an input voltage to a driving voltage and supplies the driving voltage to the light source groups. The compensator is connected to the light source groups and compensates a deviation between currents fed back to the compensator from the light source groups. The detector is connected between the compensator and the light source groups and detects a maximum voltage from among feedback voltages fed back to the compensator from each of the light source groups. The protector is connected to the detector, and receives the maximum voltage, compares the maximum voltage to a reference voltage and outputs a protection signal to the converter based on a compared result.

In one or more exemplary embodiments, the detector includes a plurality of first diodes connected to the light source groups, and each first diode of the plurality of first diodes has an anode connected to a corresponding light source group of the light source groups and a cathode connected to the protector.

In one or more exemplary embodiments, the protector includes a first comparator which receives the maximum voltage and the reference voltage and outputs the protection signal when the maximum voltage is greater than the reference voltage.

In one or more exemplary embodiments, the reference voltage is a maximum deviation value of deviation values of the feedback voltages fed back to the compensator from the light source groups.

In one or more exemplary embodiments, the protector further includes a second comparator which receives the protection signal from the first comparator and a dimming signal, which dims the light source groups, and outputs the protection signal when the dimming signal is at a high level.

In one or more exemplary embodiments, the compensator includes switching devices, each connected to one of the light source groups. At least one resistor is connected to each of the switching devices.

In one or more exemplary embodiments, each of the switching devices has a first terminal connected to a corresponding light source group of the light source groups, a second terminal connected to a ground terminal and a third terminal which controls an electrical connection between the first terminal and the second terminal.

In one or more exemplary embodiments, the backlight unit further includes a controller which receives the protection signal and controls a boosting operation of the converter.

In one or more exemplary embodiments, the converter includes an inductor which receives the input voltage, a second diode connected to the inductor to rectify a current based on the input voltage, a capacitor connected between the second diode and a ground terminal and which is charged by the input voltage, and a second switching device connected to the controller, the ground terminal and a node disposed between the inductor and the second diode. The controller turns off the second switching device in response to the protection signal when the maximum voltage is greater than the reference voltage.

According to additional exemplary embodiments of the present invention, a display apparatus includes a display panel, light source groups, a converter, a compensator, a detector and a protector. The display panel receives a light and displays an image using the light. Each of the light source groups has a light source and supplies the light to the display panel. The converter boosts an input voltage to a driving voltage and supplies the driving voltage to the light source groups. The compensator is connected to the light source groups and compensates a deviation between currents fed back to the compensator from the light source groups. The detector is connected between the compensator and the light source groups and detects a maximum voltage from among feedback voltages fed back to the compensator from each of the light source groups. The protector is connected to the detector, and receives the maximum voltage, compares the maximum voltage to a reference voltage and outputs a protection signal to the converter based on a compared result.

According to other additional exemplary embodiments of the present invention, a method of inspecting a backlight unit includes: boosting an input voltage to generate a driving voltage; applying the driving voltage to light source groups, each having a light source; compensating currents fed back from each of the light source groups to generate compensated currents; detecting a maximum voltage from among feedback voltages of each of the light source groups, the feedback voltages adjusted based on the compensated currents; comparing the maximum voltage to a reference voltage to generate a compared result and output a protection signal based on the compared result; and controlling the boosting the input voltage based on the protection signal.

In one or more exemplary embodiments, the compensating the currents maintains the feedback voltages at a constant level.

In one or more exemplary embodiments, the reference voltage is a maximum deviation value of deviation values of the feedback voltages that are fed back from the light source groups.

In one or more exemplary embodiments, when the maximum voltage is greater than the reference voltage, the protection signal interrupts the boosting the input voltage.

Thus, according to the exemplary embodiments described herein, a backlight unit and a display apparatus having the same detect an abnormal operation of light sources, and thereby interrupt an operation of light source groups using a self-detection function.

In addition, in an inspection method of the backlight unit according to one or more additional exemplary embodiments, the backlight unit has the self-detection function and thus detects defects of the light sources, thereby easily fixing the defects and substantially reducing inspection costs of the backlight unit.

BRIEF DESCRIPTION OF THE DRAWINGS

The above and other aspects and features of the present invention will become more readily apparent by describing in further detail exemplary embodiments thereof with reference to the accompanying drawings, in which.

DETAILED DESCRIPTION OF THE INVENTION

Figure 1:
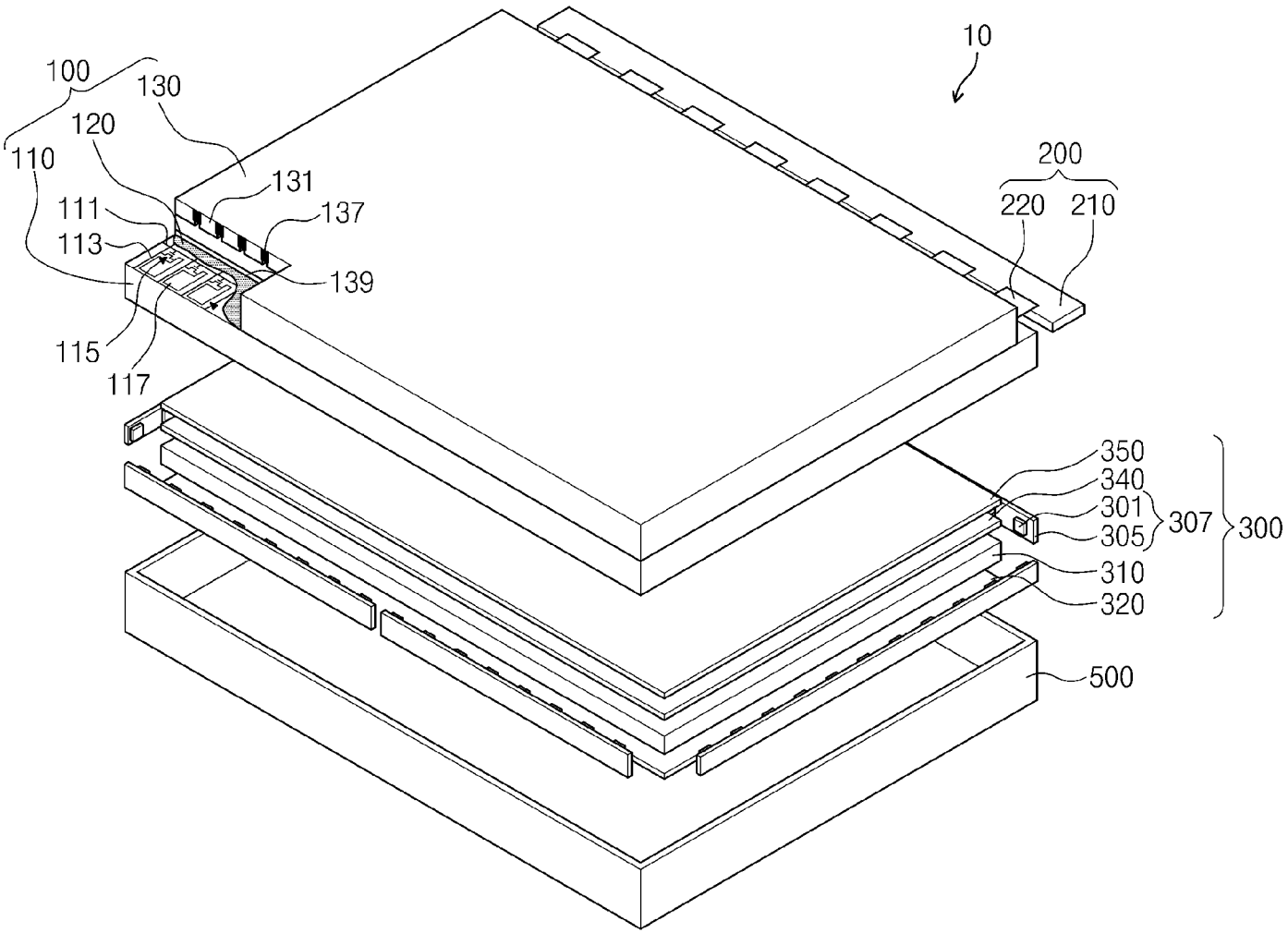
FIG. 1 is an exploded perspective view of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

FIG. 1 is an exploded perspective view of an exemplary embodiment of a display apparatus according to the present invention.

Referring to FIG. 1, a display apparatus 10 includes a display panel 100, a driving circuit 200, a backlight unit 300 and a chassis 500.

The display panel 100 receives a light to display an image using the light. The display panel 100 includes a lower substrate 110, and an upper substrate 130 facing, e.g., disposed opposite to, the lower substrate 110, and a liquid crystal layer 120 interposed between the lower substrate 110 and the upper substrate 130. To display the image, a transmittance of the light passing through the liquid crystal layer is controlled.

The lower substrate 110 includes a first base substrate including a glass or a plastic material, for example. The lower substrate 110 includes gate lines 111 disposed on the first base substrate and which extend along a first direction, e.g., a longitudinal direction (as viewed in FIG. 1), and are alternately arranged along a second direction substantially perpendicular to the first direction. In addition, the gate lines 111 are spaced apart from each other on the first base substrate, and data lines 113 extend along the second direction on the first base substrate to cross the gate lines 111, as shown in FIG. 1. Thin film transistors ("TFTs") 115 are connected to a corresponding gate line 111 of the gate lines 111 and a corresponding data line 113 of the data lines 113, and a pixel electrode 117 is connected to each of the thin film transistors 115. For purposes of illustration in FIG. 1, only one gate line 111 has been shown, but it will be understood that exemplary embodiments are not limited thereto (nor are exemplary embodiments limited by numbers of other components, such as data lines 113, TFTs 115 or pixel electrodes 117 shown in FIG. 1).

The upper substrate 130 includes a second base substrate including glass or plastic, for example. The upper substrate 130 includes a plurality of color filters 131 arranged in predetermined patterns on the second base substrate and corresponding to the pixel electrodes 117 of the lower substrate 110. In addition, the upper substrate 130 includes a black matrix 137, portions of which are arranged between two adjacent color filters 131, and a common electrode 139 that forms an electric field with the pixel electrodes 117 to drive, e.g., control an alignment of, the liquid crystal layer 120 to display the image.

The driving circuit 200 according to one or more exemplary embodiments includes a gate driver (not shown), a data driver (not shown), a controller (not shown) and a circuit substrate 210 to supply various driving signals to the display panel 100 and/or to the abovementioned components of the driving circuit 200. The controller is disposed on, e.g., mounted on, the circuit substrate 210 and is electrically connected to the lower substrate 110 by signal transmission films 220.

The gate driver may be directly formed on the lower substrate 110 or, alternatively, may be mounted on the lower substrate 110 and/or the signal transmission films 220 in a form of a chip. Likewise, the data driver may be mounted on the lower substrate 110 or, alternatively, on the signal transmission films 220 in a form of a chip, for example.

The backlight unit 300 includes at least one light source group 307, a light guide plate 310, a reflection sheet 320, a diffusion sheet 340 and a prism sheet 350 to supply the light to the display panel 100.

The light source group 307 includes at least one light source 301, e.g., a light emitting diode ("LED") 301, and an LED bar 305 on which the LED 301 or, alternatively, a plurality of the LEDs 301, are disposed, e.g., are mounted. The LEDs 301 receive a driving voltage, described in greater detail below, via the LED bar 305. The LED bar 305 on which the LEDs 301 are mounted is arranged adjacent to a side surface of the display panel 100.

The light guide plate 310 includes a transparent material which refracts light. The light guide plate 310 receives the light through an incident surface thereof, adjacent to the light source group 307, and changes a traveling direction of the light. The light guide plate 310 refracts the light incident through the incident surface, and supplies the refracted light to the display panel 100.

The reflection sheet 320 includes a base sheet and a light reflection layer disposed, e.g., arranged, on the base sheet and disposed under the light guide plate 310, as shown in FIG. 1. The reflection sheet 320 reflects light which leaks from a lower surface of the light guide plate 310, and a loss of the light traveling through the light guide plate 310 is thereby substantially reduced.

The diffusion sheet 340 is arranged on the light guide plate 310 and receives the light exiting from the light guide plate 310. The diffusion sheet 340 diffuses the received light from the light guide plate 310 such that the light is uniformly supplied to the display panel 100.

The prism sheet 350 is arranged on the diffusion sheet 340 and receives the diffused light from the diffusion sheet 340. The prism sheet 350 collects the received light exiting from the diffusion sheet 340 such that the light is supplied vertically incident to the display panel 100. In one or more exemplary embodiments, the diffusion sheet 340 and the prism sheet 350 may be a combination of two or three sheets, but alternative exemplary embodiments are not limited thereto.

The chassis 500 receives the display panel 100 and the backlight unit 300 therein and protects the display panel 100 and the backlight unit 300 from damage from external impact, for example.

Figure 2:
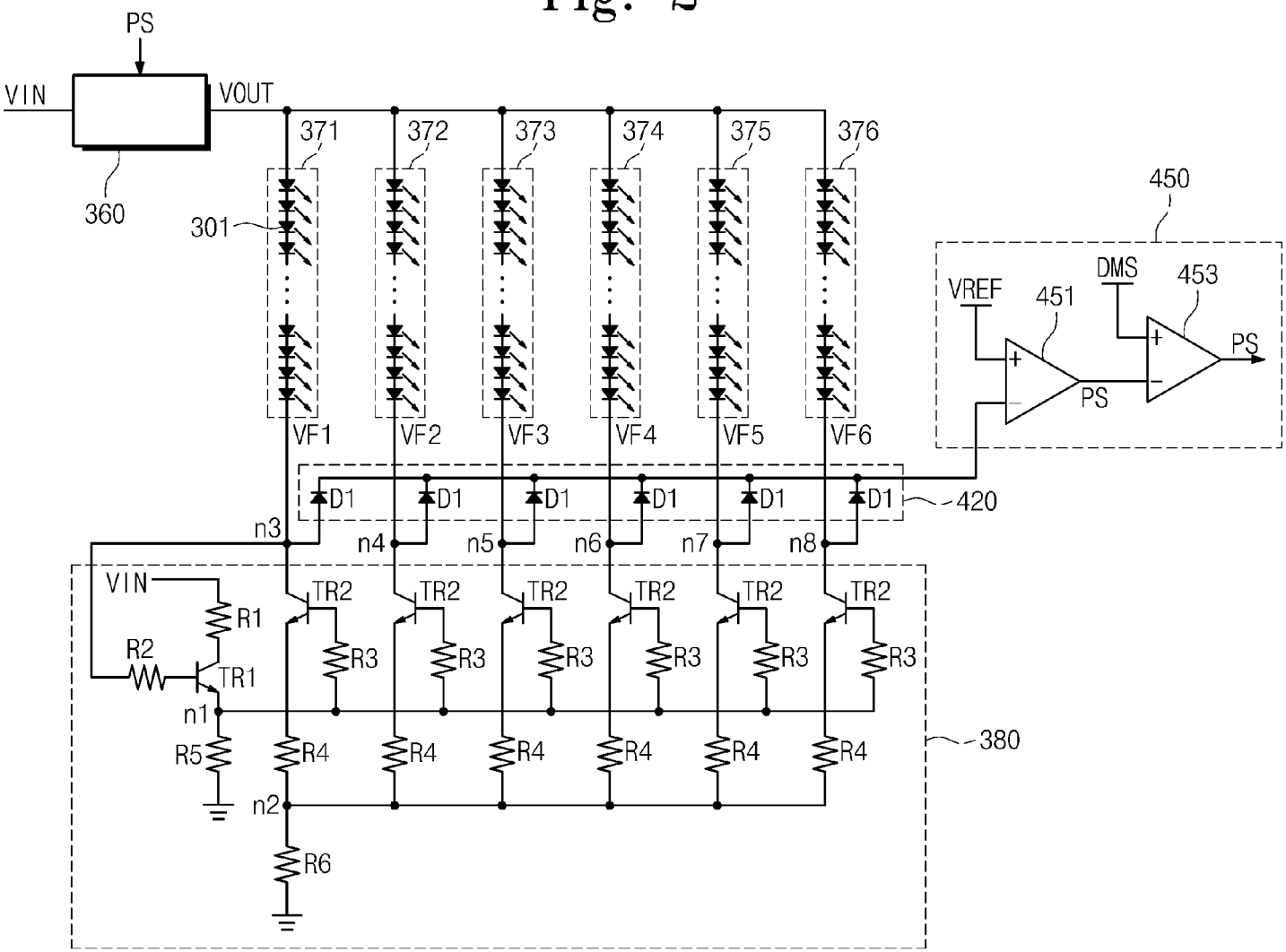
FIG. 2 is a schematic circuit diagram of an exemplary embodiment of a backlight unit according to the present invention.

FIG. 2 is a schematic circuit diagram of an exemplary embodiment of a backlight unit according to the present invention.

Referring to FIG. 2, in one or more exemplary embodiments, a backlight unit 300 of the display apparatus 10 (FIG. 1) includes a converter 360, a plurality light source groups, e.g., a first light source group 371, a second light source group 372, a third light source group 373, a fourth light source group 374, a fifth light source group 375 and a sixth light source group 376 (hereinafter collectively referred to as "light source groups 371 through 376" or "first through sixth light source groups 371 through 376"), a compensator 380, a detector 420 and a protector 450.

The converter 360 receives an input voltage VIN, supplied from an exterior source (not shown) and converts the input voltage VIN to a driving voltage VOUT to output the driving voltage VOUT to the light source groups 371 through 376.

Each of the light source groups 371 through 376 includes a plurality of the LEDs 301, which, within a given light source group, are connected to each other in electrical series, as shown in FIG. 2. The light source groups 371 through 376 are connected to each other in electrical parallel, and input terminals of the light source groups 371 through 376 are connected to an output terminal of the converter 360. Each light source group of the first through sixth light source groups 371 through 376 receives the driving voltage VOUT from the converter 360 and generates light based on, e.g., in response to, the driving voltage VOUT.

The compensator 380 according to one or more exemplary embodiments includes a current mirror circuit (not shown) and compensates a deviation between currents that are fed back from each of the first through sixth light source groups 371 through 376. To compensate the deviations of the currents, the compensator 380 includes a first switching device TR1, a plurality of second switching devices TR2, a first resistor R1, a second resistor R2, a plurality of third resistors R3, a plurality of fourth resistors R4, a fifth resistor R5 and a sixth resistor R6.

The first switching device TR1 includes a collector to which the input voltage VIN is applied via the first resistor R1, a base to which a first feedback voltage VF1, fed back from the first light source group 371, is applied via the second resistor R2, and an emitter connected to the fifth resistor R5. The first switching device TR1 is turned on in response to the first feedback voltage VF1.

Each of the second switching devices TR2 includes a base connected to the emitter of the first switching device TR1 via a corresponding third resistor R3 of the plurality of third resistors R3, a collector connected to a corresponding light source group of the first through sixth light source groups 371 through 376, and an emitter connected to a corresponding fourth resistor R4 of the plurality of fourth resistors R4. The base of each second switching device TR2 is connected to the emitter of the first switching device TR1 at a first node n1, e.g., a first connection node n1. Respective collectors of the second switching devices TR2 receive the first feedback voltage VF1, a second feedback voltage VF2, a third feedback voltage VF3, a fourth feedback voltage VF4, a fifth feedback voltage VF5 and a sixth feedback voltage VF6, which are fed back from the first through sixth light source groups 371 through 376, respectively. Each of the second switching devices TR2 is turned on in response to an emitter voltage of the switching device TR1.

The fourth resistors R4 are commonly connected to a second node n2. The fifth resistor R5 is connected between the emitter of the first switching device TR1 and a ground terminal, and the sixth resistor R6 is connected between the second node n2 and the ground terminal.

In the compensator 380, currents flowing through the bases of the switching devices TR2 have a same level, since the bases of the second switching devices TR2 are commonly connected at the first node n1. A collector current of each second switching devices TR2 is determined by a current gain thereof, the first through sixth feedback voltages VF1 through VF6, and resistance components of the first through sixth light source groups 371 through 376. In one or more exemplary embodiments, a voltage between the base and the emitter of each of the second switching devices TR2 is constant. In addition, in an exemplary embodiment, the current gain is greater than one (1), and the collector current of each of the second switching devices TR2 is determined by the first through sixth feedback voltages VF1 through VF6 and the resistance components of to the first through sixth light source groups 371 through 376, and the collector current of each of the second switching devices TR2 has a constant value. It will be noted that, while the current gain may vary, the collector current of each of the second switching devices TR2 has an effectively constant value, since any variation of the current gain is relatively small compared to the other factors described above. Accordingly, the compensator 380 according to an exemplary embodiment maintains the currents fed back from the first through sixth light source groups 371 through 376 at a substantially constant level.

The detector 420 receives feedback voltages fed back from the first through sixth light source groups 371 through 376 and supplies a maximum voltage from among the feedback voltages to the protector 450. In one or more exemplary embodiments of the present invention, the detector 420 includes a plurality of first diodes D1, and first diodes D1 of the plurality of first diodes D1 are connected to each other in electrical parallel, as shown in FIG. 2.

Specifically, each of the first diodes D1 includes an anode connected to the collector of a corresponding second switching device TR2 of the plurality of second switching devices TR2, and a cathode connected to the protector 450. More specifically, connecting nodes between the first diodes D1 and corresponding second switching devices TR2 are referred to as a third node n3, a fourth node n4, a fifth node n5, a sixth node n6, a seventh node n7 and an eighth node n8, as shown in FIG. 2. The protector 450 includes a first comparator 451 which receives the maximum voltage from the detector 420.

The first comparator 451 includes a first input terminal commonly connected to the cathodes of the first diodes D1 and a second input terminal which receives a reference voltage VREF, which in an exemplary embodiment is a predetermined reference voltage VREF. In one or more exemplary embodiments, the reference voltage VREF is a maximum deviation value of deviation values of the first through sixth feedback voltages VF1 through VF6. Alternatively (or additionally), the reference voltage VREF may be a maximum deviation value of deviation values of the driving voltage VOUT applied to each light source group 371 through 376. More particularly, the driving voltage VOUT applied to each of the first through sixth light source groups 371 through 376 may have a voltage level ranging from a first critical value to a second critical value, which are determined based on a number of the LEDs 301 included of each light source group 371 through 376 and/or characteristics of the LEDs 301, for example. In an exemplary embodiment, the first critical value is a minimum value of the driving voltage VOUT, and the second critical value is a maximum value of the driving voltage VOUT. Thus, since the driving voltage VOUT has the voltage level between the first and second critical values, a maximum deviation value of the driving voltage VOUT corresponds to a difference value between the first critical value and the second critical value.

In addition, the reference voltage VREF, which may be defined as the maximum deviation value of the driving voltage VOUT, has a value less than a driving voltage VOUT of one of the LEDs. Put another way, the reference voltage VREF is less than a feedback voltage fed back from a corresponding light source group when at least one of the LEDs 301 therein has a fault, e.g., is shorted. Therefore, when the maximum voltage supplied from the detector 420 is greater than the reference voltage VREF, the first comparator 451 outputs a protection signal PS.

Cathodes of the first diodes D1 included in the detector 420 are connected to the third through eighth nodes n3 through n8, and anodes of the first diodes D1 are commonly connected to the first input terminal of the first comparator 451. Thus, the first diodes D1 receive the first through sixth feedback voltages VF1 through VF6 via the third through eighth nodes n3 through n8, respectively, and supply the first through sixth feedback voltages VF1 through VF6 to the first input terminal of the first comparator 451. Since the anodes of the first diodes D1 are connected in electrical parallel to the first input terminal, an input voltage applied to the first input terminal of the first comparator 451 is based on an average value of the first through sixth feedback voltages VF1 through VF6. Specifically, when one of the LEDs 301 included in the sixth light source group 376, for example, is shorted, the sixth feedback voltage VF6 increases to become greater than each of the first through fifth feedback voltages VF1 through VF5. Accordingly, the input voltage applied to the first input terminal changes based on the increased sixth feedback voltage VF6. Since the increased sixth feedback voltage VF6 is larger than the first through fifth feedback voltages VF1 through VF5, the input voltage of the first input terminal has a voltage level substantially the same as the sixth feedback voltage VF6.

In an exemplary embodiment, the first diodes D1 of the detector 420 prevents a reverse current from the first comparator 451 to the first through sixth light source groups 371 through 376.

As described above, when at least one of the LEDs 301 has a fault, e.g., is shorted, in one or more of the first through sixth light source groups 371 through 376, the detector 420 detects an abnormal condition due to the shorted LED 301 (or plurality thereof). Thus, when at least one of the LEDs 301 included in each of the first through sixth light source groups 371 through 376 is shorted, the detector 420 outputs a feedback voltage that is increased greater than the reference voltage VREF. As a result, the input voltage applied to the first comparator 451 increases by the increased feedback voltage.

When one LED 301 of the LEDs 301 is shorted, an overall brightness of the light source group including the shorted LED 301 decreases by the brightness of the shorted LED 301, but it is difficult, during an inspection, for example, to perceive this relatively small change of the brightness with a human eye. However, the detector 420 according to the exemplary embodiments described herein easily detect the defect or defects of one or more of the LEDs 301 using the voltages fed back from the first through sixth light source groups 371 through 376, as described above. As a result, the defect of the LEDs 301 is easily detected thereby substantially improving an efficiency of an inspection of the display apparatus 10 according to one or more exemplary embodiments.

In exemplary embodiments of the present invention, the protector 450 further includes a second comparator 453 which receives the protection signal PS from the first comparator 451 and a dimming signal DMS for dimming of the first through sixth light source groups 371 through 376. The dimming signal DMS may control a brightness of the first through sixth light source groups 371 through 376 based on a duty ratio, e.g., according to a ratio of a low level period with respect to a high level period of the dimming signal DMS. The dimming signal DMS is supplied to the second comparator 453 using a pulse width modulation ("PWM") method, for example. In an exemplary embodiment, the second comparator 453 receives the protection signal PS and outputs the protection signal PS to the converter 360 during the high level period of the dimming signal DMS.

Figure 3:
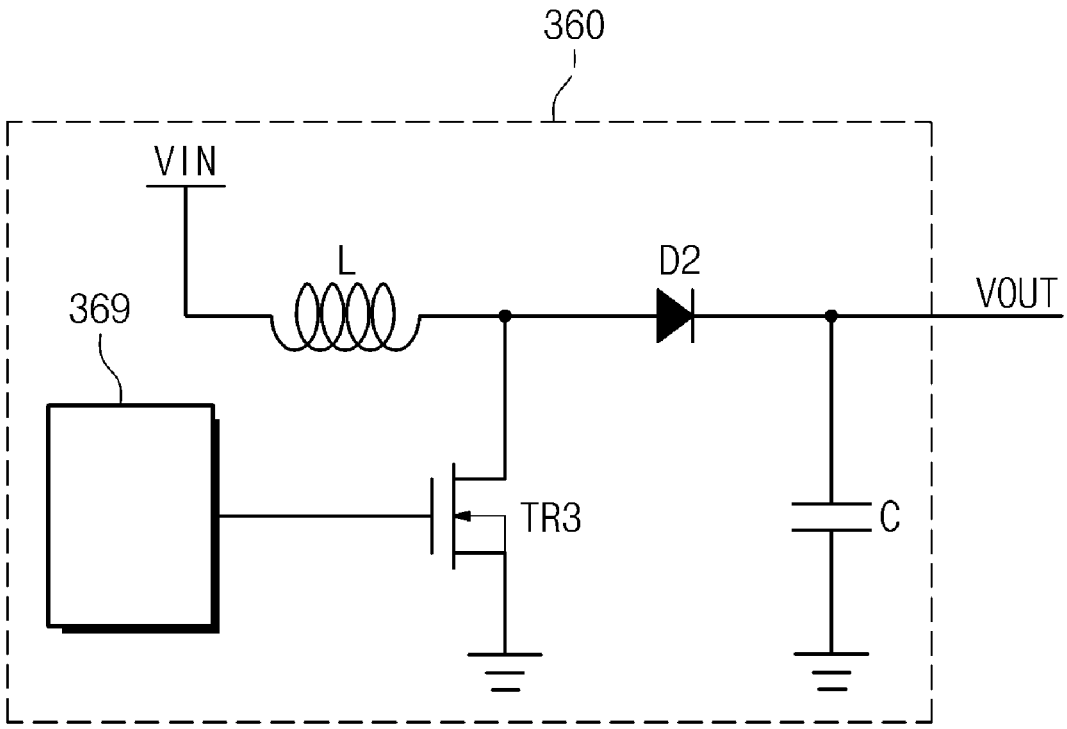
FIG. 3 is a schematic circuit diagram of a converter of the backlight unit shown in FIG. 2.

FIG. 3 is a schematic circuit diagram of a converter 360 of the backlight unit 300 shown in FIG. 2.

Referring to FIG. 3, the converter 360 converts the input voltage VIN supplied from an external source (not shown) to the driving voltage VOUT to supply the driving voltage VOUT to the light source groups 371 through 376. As shown in FIG. 3, the converter 360 includes an inductor L, a second diode D2, a capacitor C, a third switching device TR3 and a controller 369.

The inductor L is connected to the input terminal of the converter 360 and receives the input voltage VIN. The second diode D2 is connected to the inductor L and rectifies a current which is generated depending on the input voltage VIN. The capacitor C is connected between the second diode D2 and a ground terminal and is charged by the input voltage VIN applied thereto via the second diode D2. The third switching device TR3 is connected to the controller 369, the ground terminal and a connection node between the inductor L and the second diode D2. The controller 369 is connected to the third switching device TR3 and controls an operation of the third switching device TR3. Thus, the converter 360 boosts the input voltage VIN based on a switching operation of the third switching device TR3.

The controller 369 receives the protection signal PS from the protector 450 and controls the switching operation of the third switching device TR3 based on the protection signal PS. More particularly, when the controller 369 receives the protection signal PS, the controller 369 turns off the third switching device TR3. When the third switching device TR3 is turned off, the converter 360 does not boost the input voltage VIN to the driving voltage VOUT.

Figure 4:
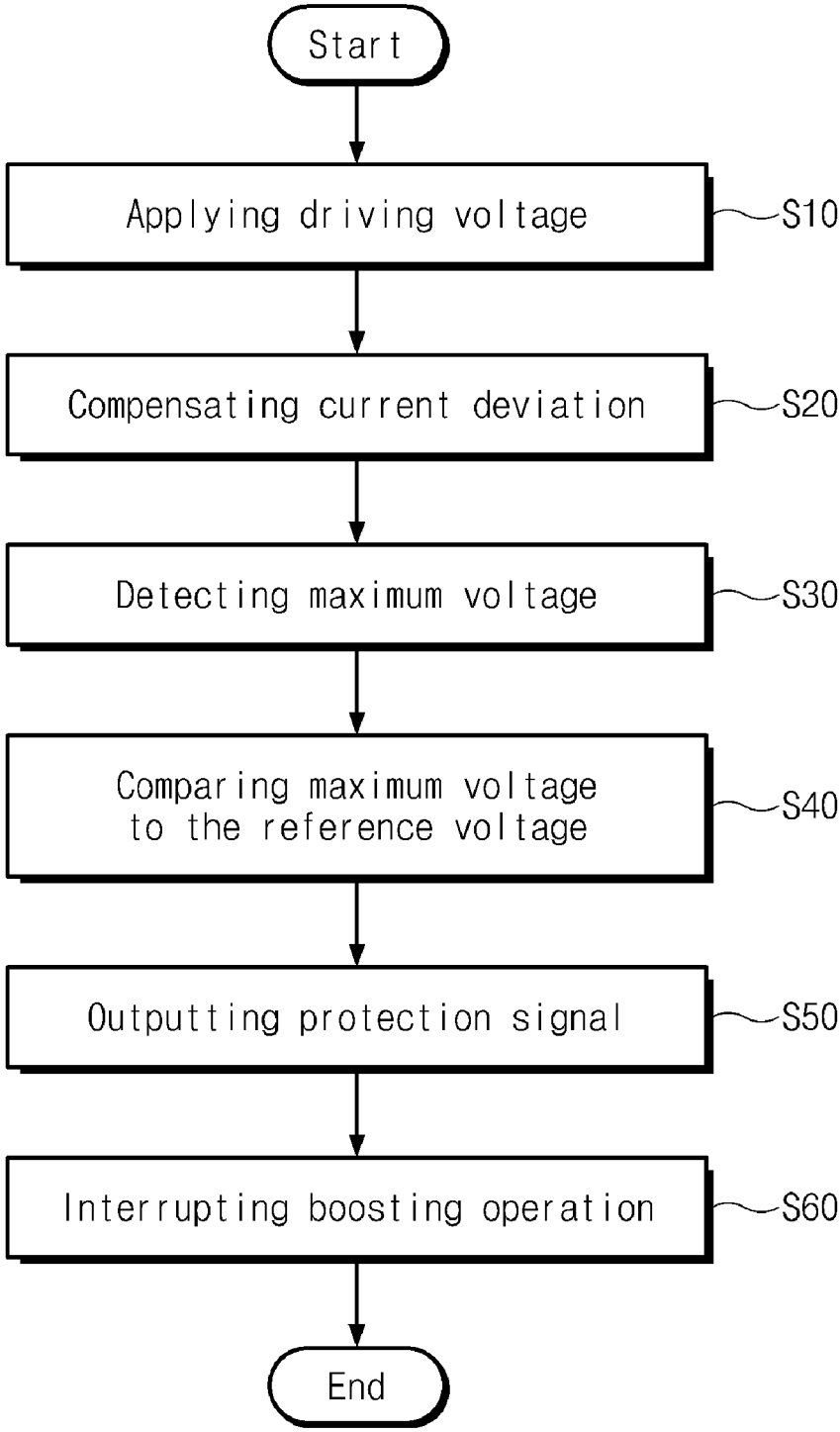
FIG. 4 is a flow chart illustrating an exemplary embodiment of a method of inspecting a backlight unit according to the present invention.

FIG. 4 is a flow chart illustrating an exemplary embodiment of a method of inspecting, e.g., testing, a backlight unit according to the present invention.

Referring to FIGS. 1 through 4, the converter 360 boosts the input voltage supplied from an external source (no shown) to the driving voltage VOUT to drive the light source groups (step S10). Next, the driving voltage VOUT is applied to the light source groups 371 through 376, each having the light sources 301, e.g., the LEDs 301, connected to each other in electrical series (step S20). The compensator 380 compensates the currents fed back from the light source groups 371 through 376 (step S30). The compensator 380 includes the current mirror circuit (not shown) to maintain the currents fed back from the light source groups 371 through 376 at a constant level, as described in greater detail above.

The detector 420 detects the maximum voltage among the feedback voltages VF1 through VF6 adjusted by the compensated currents (step S40). The protector 450 receives the reference voltage VREF and compares the maximum voltage to the reference voltage VREF to output a protection signal PS that controls the boosting operation of the converter 360 based on a compared result (step S50). The protector 450 includes the first comparator 451 and outputs the protection signal PS when the maximum voltage is greater than the reference voltage VREF, which is defined as the maximum deviation value of deviation values of the feedback voltages VF1 through VF6 fed back from the light source groups 371 through 376. If the maximum voltage is less than the reference voltage VREF, the protector 450 again receives the maximum voltage from the detector 420 and compares the maximum voltage to the reference voltage VREF.

In one or more exemplary embodiments of the present invention, the protector 450 further includes the second comparator 453 which receives the protection signal PS and the dimming signal DMS (for dimming of the light source groups 371 through 376) and outputs the protection signal PS during the high level period of the dimming signal DMS through the second comparator 453, as described in greater detail above with reference to FIG. 2.

The converter 360 stops the boosting operation in response to the protection signal PS (step S60). Accordingly, the light source groups 371 through 376, which each receive the driving voltage VOUT from the converter 360, stop generating the light, thereby allowing an inspector to easily and efficiently detect an abnormal condition of the light source (or a plurality thereof).

According to exemplary embodiments described herein, a backlight unit and a display apparatus having the same detect an abnormal operation of light sources therein and interrupt operation of light source groups using a self-detection function, thereby allowing for efficient detection and fixing of defects, substantially reducing an inspection cost due to the defect.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A backlight unit comprising:

light source groups, each including a light source;

a converter which boosts an input voltage to a driving voltage which is supplied to the light source groups;

a compensator connected to the light source groups and which compensates a deviation between currents fed back to the compensator from each of the light source groups;

a detector connected between the light source groups and the compensator and which detects a maximum voltage from among feedback voltages fed back to the compensator from each of the light source groups; and a protector connected to the detector, wherein the protector receives the maximum voltage, compares the maximum voltage to a reference voltage to generate a compared result and outputs a protection signal to the converter based on the compared result.

2. The backlight unit of claim 1, wherein the detector comprises a plurality of first diodes, each first diode of the plurality of first diodes having an anode connected to a corresponding light source group of the light source groups and a cathode connected to the protector.

3. The backlight unit of claim 1, wherein the protector comprises a first comparator which receives the maximum voltage and the reference voltage, and the first comparator outputs the protection signal when the maximum voltage is greater than the reference voltage.

4. The backlight unit of claim 3, wherein the reference voltage is a maximum deviation value of deviation values of the feedback voltages fed back to the compensator from each of the light source groups.

5. The backlight unit of claim 3, wherein the protector further comprises a second comparator which receives the protection signal from the first comparator and a dimming signal which dims the light source groups, and the second comparator outputs the protection signal when the dimming signal is at a high level.

6. The backlight unit of claim 1, wherein the compensator comprises switching devices, each connected to one of the light source groups, and at least one resistor is connected to each of the switching devices.

7. The backlight unit of claim 6, wherein each of the switching devices comprises:

a first terminal connected to a corresponding light source group of the light source groups;

a second terminal connected to a ground terminal; and a third terminal which controls an electrical connection between the first terminal and the second terminal.

8. The backlight unit of claim 1, further comprising a controller which receives the protection signal and controls a boosting operation of the converter.

9. The backlight unit of claim 2, wherein the converter comprises:

a controller which receives the protection signal and controls a boosting operation of the converter;

an inductor which receives the input voltage;

a second diode which is connected to the inductor and rectifies a current which is based on the input voltage;

a capacitor connected between the second diode and a ground terminal and which is charged by the input voltage; and a switching device connected to the controller, the ground terminal and a node disposed between the inductor and the second diode, wherein the controller turns off the switching device in response to the protection signal when the maximum voltage is greater than the reference voltage.

10. A display apparatus comprising:

a display panel which receives a light and displays an image;

light source groups which supply the light to the display panel, each of the light source groups including a light source;

a converter which boosts an input voltage to a driving voltage and supplies the driving voltage to the light source groups;

a compensator connected to the light source groups and which compensates a deviation between currents fed back to the compensator from the light source groups;

a detector connected between the light source groups and the compensator and which detects a maximum voltage from among feedback voltages fed back to the compensator from the light source groups; and a protector connected to the detector, wherein the protector receives the maximum voltage, compares the maximum voltage to a reference voltage to generate a compared result and outputs a protection signal to the converter based on the compared result.

11. The display apparatus of claim 10, wherein the detector comprises a plurality of first diodes each first diode of the plurality of first diodes having an anode connected to a corresponding light source group of the light source groups and a cathode connected to the protector.

12. The display apparatus of claim 10, wherein the protector comprises:

a first comparator which receives the maximum voltage and the reference voltage; and a second comparator which receives the protection signal from the first comparator and a dimming signal, which dims the light source groups, wherein the first comparator outputs the protection signal when the maximum voltage is greater than the reference voltage, and the second comparator outputs the protection signal when the dimming signal is at a high level.

13. The display apparatus of claim 12, wherein the reference voltage is a maximum deviation value of deviation values of the feedback voltages fed back to the compensator from each of the light source groups.

14. The display apparatus of claim 10, wherein the compensator comprises:

switching devices, each comprising:

a first terminal connected to a corresponding light source group of the light source groups;

a second terminal connected to a ground terminal; and a third terminal which controls an electrical connection between the first terminal and the second terminal, wherein at least one resistor is connected to each of the switching devices.

15. The display apparatus of claim 10, further comprising a controller which receives the protection signal and controls a boosting operation of the converter.

16. The display apparatus of claim 11, wherein the converter comprises:

an inductor which receives the input voltage;

a second diode which is connected to the inductor and rectifies a current which is based on the input voltage;

a capacitor connected between the second diode and a ground terminal and which is charged by the input voltage; and a switching device connected to the controller, the ground terminal and a node disposed between the inductor and the second diode, wherein the controller turns off the switching device in response to the protection signal when the maximum voltage is greater than the reference voltage.

17. A method of inspecting a backlight unit, the method comprising:

boosting an input voltage to generate a driving voltage;

applying the driving voltage to light source groups, each having a light source;

compensating currents fed back from each of the light source groups to generate compensated currents;

detecting a maximum voltage from among feedback voltages of each of the light source groups, the feedback voltages adjusted based on the compensated currents;

comparing the maximum voltage to a reference voltage to generate a compared result and output a protection signal based on the compared result; and controlling the boosting the input voltage based on the protection signal.

18. The method of claim 17, wherein the compensating the currents maintains the feedback voltages at a constant level.

19. The method of claim 17, wherein the reference voltage is a maximum deviation value of deviation values of the feedback voltages fed back from the light source groups.

20. The method of claim 17, wherein the protection signal interrupts the boosting the input voltage when the maximum voltage is greater than the reference voltage.

* * * * *